US006438885B1

(12) United States Patent
Murray et al.

(10) Patent No.: US 6,438,885 B1
(45) Date of Patent: Aug. 27, 2002

(54) WEAPON TRIGGER GUARD APPARATUS

(75) Inventors: Kurt R. Murray; Richard N. Mercurio, both of Carmel, IN (US)

(73) Assignee: Pro-Guard Industries, L.P., Indianapolis, IN (US)

( * ) Notice: Subject to any disclaimer, the term of this patent is extended or adjusted under 35 U.S.C. 154(b) by 0 days.

(21) Appl. No.: 09/364,136

(22) Filed: Jul. 30, 1999

Related U.S. Application Data

(60) Provisional application No. 60/094,942, filed on Jul. 31, 1998, and provisional application No. 60/104,451, filed on Oct. 16, 1998.

(51) Int. Cl.[7] ..... F41A 17/46

(52) U.S. Cl. ..... 42/70.07; 42/94; 211/64; 70/19; 224/199; 224/224; 224/913

(58) Field of Search ..... 211/64; 42/70.07, 42/94; 70/70.11

(56) References Cited

U.S. PATENT DOCUMENTS

| | | | | |
|---|---|---|---|---|
| 1,136,691 A | * | 4/1915 | Mease | |
| 2,316,995 A | | 4/1943 | Smith | 224/1 |
| 2,668,645 A | | 2/1954 | Pease | 224/1 |
| 2,929,539 A | | 3/1960 | Safreno | 224/1 |
| 3,261,521 A | | 7/1966 | Meccico et al. | 224/42.44 |
| 3,265,261 A | | 8/1966 | Kenrick et al. | 224/29 |
| 3,326,385 A | | 6/1967 | Pinkerton et al. | 211/4 |
| 3,473,673 A | | 10/1969 | Porter | 211/64 |
| 3,524,572 A | | 8/1970 | Hall | 224/42.1 |
| 3,767,093 A | | 10/1973 | Pinkerton et al. | 224/1 R |
| 3,802,612 A | * | 4/1974 | Smith | 224/1 R |
| 3,857,491 A | | 12/1974 | Townsend et al. | 211/8 |
| 4,030,221 A | * | 6/1977 | Doobenen et al. | 41/1 |
| 4,120,436 A | | 10/1978 | Burch | 224/42.1 |
| 4,132,315 A | | 1/1979 | Young | 211/4 |
| 4,226,399 A | | 10/1980 | Henderson | 248/553 |
| 4,364,499 A | | 12/1982 | McCue | 224/42.45 |
| 4,579,263 A | * | 4/1986 | Ehmke et al. | 224/42.42 |
| 4,648,516 A | | 3/1987 | Elkins | 211/64 |
| 4,747,280 A | | 5/1988 | Shaw | 70/279 |
| 4,881,386 A | * | 11/1989 | Glines | 70/19 |
| 4,949,559 A | | 8/1990 | Glines | 70/19 |
| 5,078,279 A | | 1/1992 | Hancock et al. | 211/64 |
| 5,078,309 A | | 1/1992 | Hull et al. | 224/42.45 |
| 5,116,010 A | | 5/1992 | McMasters et al. | 248/309.1 |
| 5,129,563 A | * | 7/1992 | Dillon | 224/275 |
| 5,350,094 A | | 9/1994 | Morford | 224/42.45 |
| D356,541 S | | 3/1995 | Morford | D12/406 |
| 5,438,787 A | | 8/1995 | McMasters et al. | 42/106 |
| 5,531,368 A | * | 7/1996 | Morford | 224/551 |
| 5,621,996 A | * | 4/1997 | Mowl, Jr. | 42/70.07 |
| 5,768,819 A | * | 6/1998 | Neal | 42/96 |
| 5,779,120 A | * | 7/1998 | Morford | 224/571 |
| 5,791,499 A | * | 8/1998 | Zebbedies | 211/64 |
| 5,816,546 A | | 10/1998 | Miller | 248/205.1 |
| 6,047,870 A | | 4/2000 | Morford | 224/551 |

FOREIGN PATENT DOCUMENTS

| | | |
|---|---|---|
| GB | 2185064 | 7/1987 |
| JP | 6430855 | 2/1989 |

OTHER PUBLICATIONS

Pro–Guard Industries, Jul. 1990, item Model No. 3C33200, Catalog extracts.*

(List continued on next page.)

*Primary Examiner*—Charles T. Jordan
*Assistant Examiner*—John A Richardson
(74) *Attorney, Agent, or Firm*—Bose McKinney & Evans LLP

(57) ABSTRACT

A weapon trigger guard apparatus is provided for use on a gun rack having a support member and a lock coupled to the support member. The weapon trigger guard apparatus comprises a base rigidly coupled to the support member of the rack, and a cover pivotably coupled to the base. The cover is movable between a first open position to permit installation and removal of the weapon from the rack and a second closed position in which the cover and the base cooperate to surround and enclose a trigger housing of the weapon.

19 Claims, 3 Drawing Sheets

OTHER PUBLICATIONS

Overhead Wire Screen Gun Rack, Pro–Gard Industries advertising literature, Model No. 3C–5003.
Overhead Partition Gun Rack, Pro–Gard Industries advertising literature, Model No. 3C–5002.
Big Sky Racks, Inc., Law Enforcement Weapon Mounts, "The Ultimate Mount for Concealment, Security and Accessibility".
Overhead Gun Rack, Pro–Gard Industries advertising literature, Model No. 3C–5000.
Pro–Clamp Gun Rack, Models G5010AR, G5010, G5010D, Internet site: http://www.pro –gard.com/products/pro–clamp.htm,Feb. 8, 1999.
Pro–Gard Industries advertising literature, Multi–purpose Gun Locks and Mounts Series 3C3000 and Pro–Gard XL–90 Gun Locks and Mounts Series 3C4000.
Pro–Gard Industries, "Pro–Gard Gun Mounts," advertising literature, p. 2.
Gant's 1989–90 Law Enforcement Equipment Company, pp. 19, 143, 145–147.
Photgraph of Pro–Gard product.
Photograph of Pro–Gard Product.
Pro–Tech Design and Manufacturing Inc., Memoradum subject: Weapon Racks for Vehicles.
Big Sky Racks, Inc. "The BSR Model Series," advertising literature.
Pro–Gard Gun Racks, Pro–Gard Industries advertising literature and price list, pp. 8–10.
Pro–Gard Industries, "Gun Locks," advertising literature, pp. 8–10.
Pro–Gard Industries 1998 Product Catalog, "Locks and Mounts".
Santa Cruz Gun Locks Price List.
Santa Cruz Gunlocks Models SC–1&2/AR; SC–1&2/A and SC–1&2.
Santa Cruz Lock Model SC–1.
Santa Cruz Associates Model SC–1/A and Model SC–2/A.
Pro Tech Design and Manufacturing advertisement.
Pro–Gard Product Price List, May 1, 1980.
Pro–Gard Product Price List, Sep. 1, 1981.
Pro–Gard Product Price List, Jul. 1, 1990.
Pro–Gard Gun Rack Installation Instructions.
Overhead Gun Rack, Pro–Gard Industries Advertising literature Model No. 3C–5000W.
Overhead Gun Rack—Air Bag Friendly, Pro–Gard Industries advertising literature Model No. 3C–5000.
Big Sky Racks, Inc., ELS–100 Mounts, Law Enforcement Product News, Nov.–Dec. 1984 issue.
"Best Gun Rack You'll Find Anywhere!" advertisement.
Big Sky Racks, Inc., Mounting Instructions Models BSR–1 BSR–1L, BSR–2, BSR–2W.
Big Sky Racks, Inc., "Best Gun Rack You'll Find Anywhere," Models BSR–1L, BSR–2, BSR–1.
Big Sky Racks, Inc., "The BSR Model Series".
Big Sky Racks, Inc., Pricing List Jan. 1, 1990.
Big Sky Racks, Inc., Pricing List Jan. 1, 1991.
Pro–Tech Design and Manufacturing, Inc., Model 629, "Top Gun Vehicle Weapon Mounting System".
Pisenti, D.W., "Vehicular Long–Barrel Weapons Mount", FBI Law Enforcement Bulletin, May 1991.
Pro–Clamp Gun Rack, Pro–Gard Industries advertising literature, Model No. 3C–5010.
Big Sky Racks, Inc., Overhead & Vertical, Surface Mounting for Rifles and Shotguns, General Information.

* cited by examiner

WEAPON TRIGGER GUARD APPARATUS

This application claims the benefit of U.S. provisional application Serial No. 60/094,942 filed Jul. 31, 1998 and U.S. provisional application Ser. No. 60/104,451 filed Oct. 16, 1998.

BACKGROUND AND SUMMARY OF THE INVENTION

The present invention relates to a weapon trigger guard. More particularly, the present invention relates to a weapon trigger guard for use with a gun rack.

It is known to provide gun racks to store law enforcement weapons in vehicles. Typically, these gun racks are mounted to various locations in the vehicle. The gun racks include a lock to secure the weapon to the gun rack. Typically, the lock is an electrically operated lock that has a key override feature.

Such conventional gun racks secure the weapon to the rack and provide easy access to the weapon. However, some conventional gun racks leave the trigger of the weapon exposed. The present invention relates to a trigger guard for a weapon. The trigger guard of the present invention provides an enclosure which surrounds a trigger housing of the weapon when the weapon is in a locked position within a gun rack. The cover is hinged to a base and pivots away from the base when the gun is released from the lock and removed from the rack. The cover is self closing when the weapon is placed back on the gun rack.

Additional features and advantages of the invention will become apparent to those skilled in the art upon consideration of the following detailed description of the illustrated embodiment exemplifying the best mode of carrying out the invention as presently perceived.

BRIEF DESCRIPTION OF THE DRAWINGS

A detailed description particularly refers to the accompanying figures in which.

DETAILED DESCRIPTION OF THE DRAWINGS

Figure 1:
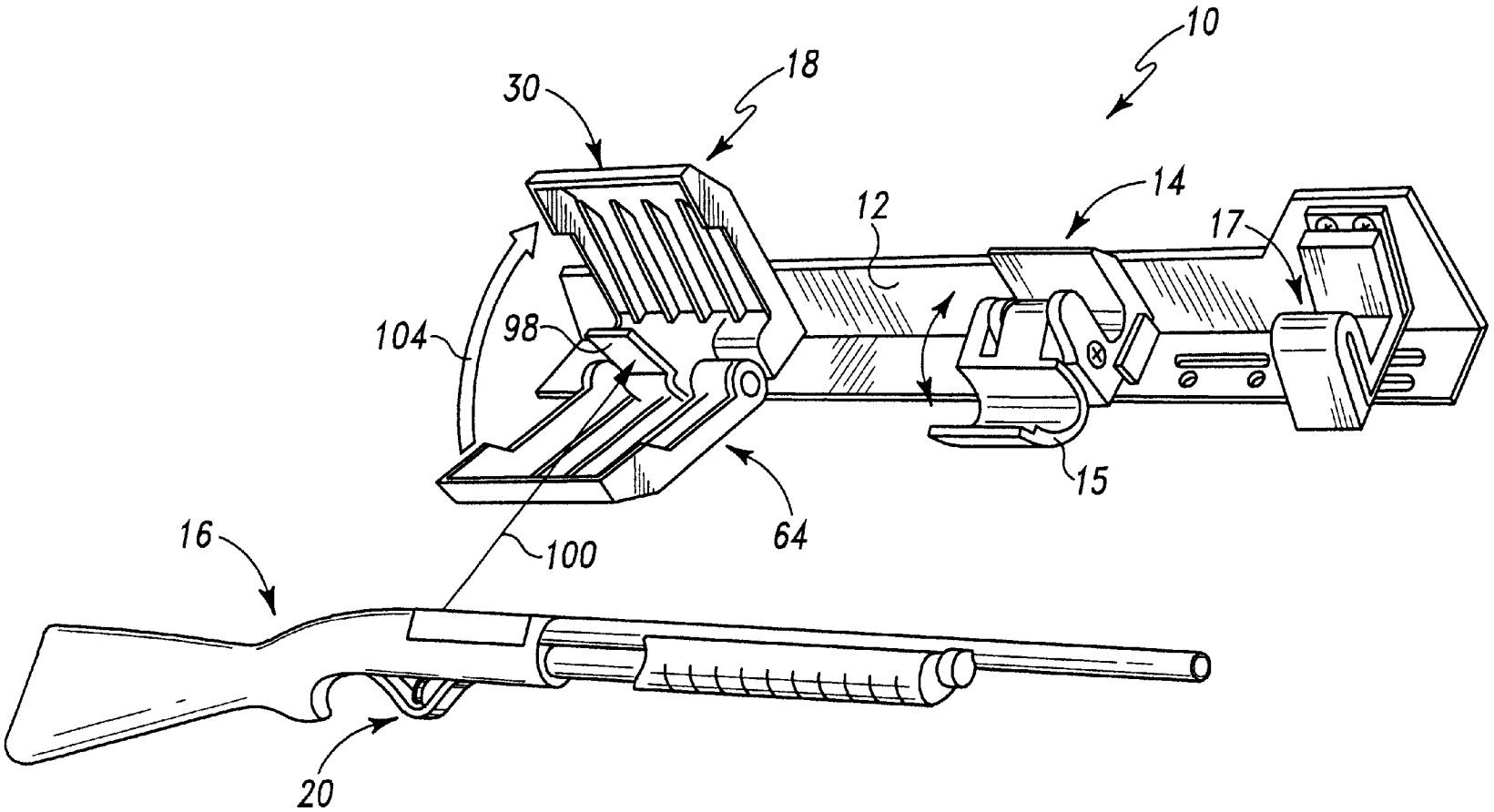
FIG. 1 is a perspective view illustrating a gun rack for receiving a weapon including a lock for securing the weapon to the gun rack and a weapon trigger guard configured to enclose a trigger housing on the weapon when the weapon is installed onto the rack.

Referring now to the drawings, FIG. 1 illustrates a gun rack 10 having an elongated support member 12 configured to be coupled to a surface in a vehicle. The gun rack 10 also includes an electrically operated lock 14 having a key override for securing a weapon 16 to the rack 10. Lock 14 includes a pivotable cover 15 to lock the weapon 16 to the rack 10. An illustrative lock 14 is described in U.S. Pat. No. 4,949,559 incorporated herein by reference and is available from Pro-Gard Industries located in Indianapolis, Indiana. It is understood that any conventional gun lock may be used in accordance with the present invention.

A barrel rest 17 is coupled to support member 12 adjacent lock 14. A weapon trigger guard 18 is also coupled to the support member 12 of gun rack 10. The weapon trigger guard 18 is configured to surround a trigger housing 20 of weapon 16 when weapon 16 is on the gun rack 10. By surrounding the weapon trigger housing 20, the weapon trigger guard 18 reduces access to the trigger housing.

Figure 2:
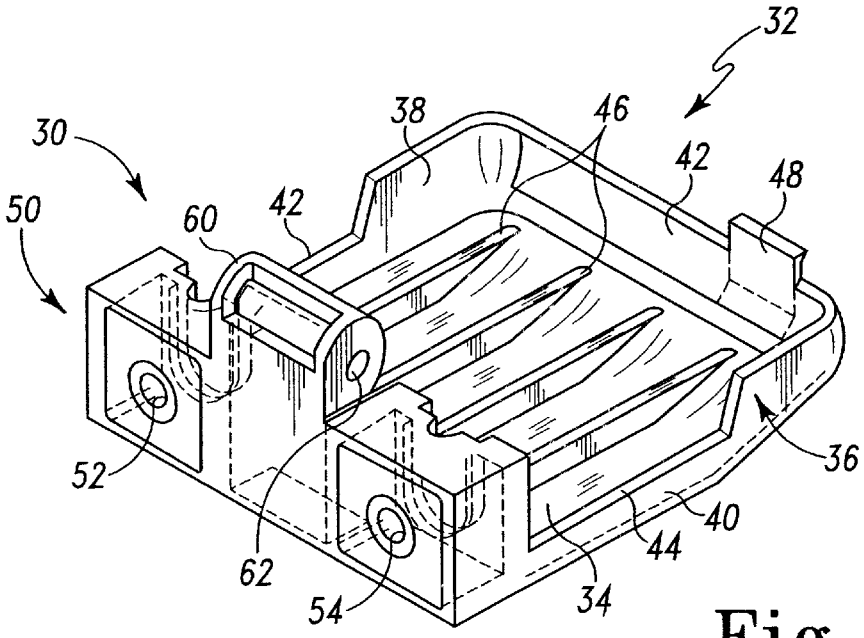
FIG. 2 is a perspective view of a base portion of the weapon trigger guard apparatus of the present invention.
Figure 3:
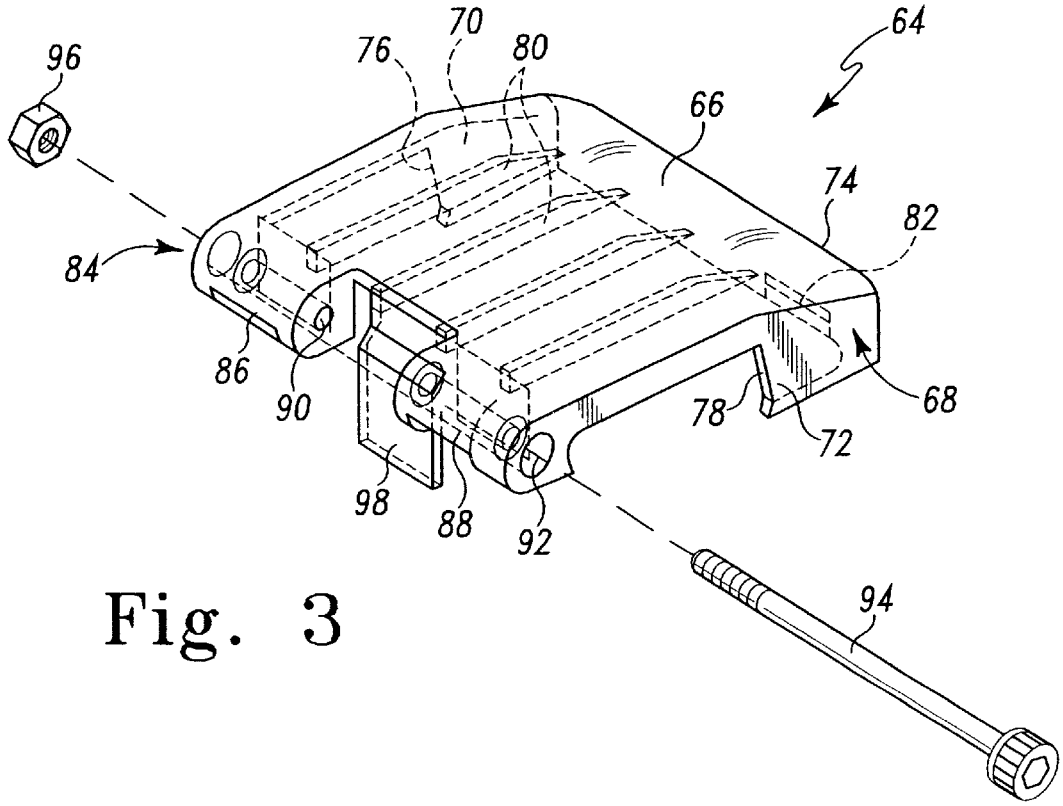
FIG. 3 is a perspective view of a cover of the weapon trigger guard of FIG. 1.

The weapon trigger guard is best illustrated in FIGS. 2–6. FIG. 2 illustrates a base portion 30 of the trigger guard 18. Base 30 includes an outer surface 34 surrounded by a side wall 36. Side wall 36 has first and second side portions 38 and 40 and a front portion 32. Side portions 38 and 40 include notched sections 42 and 44, respectively, which are configured to receive a portion of the weapon 16 as discussed below. Outer surface 34 is formed to include strengthening ribs 46. A first latched portion 48 is formed on front surface 42 of side wall 36.

Figure 4:
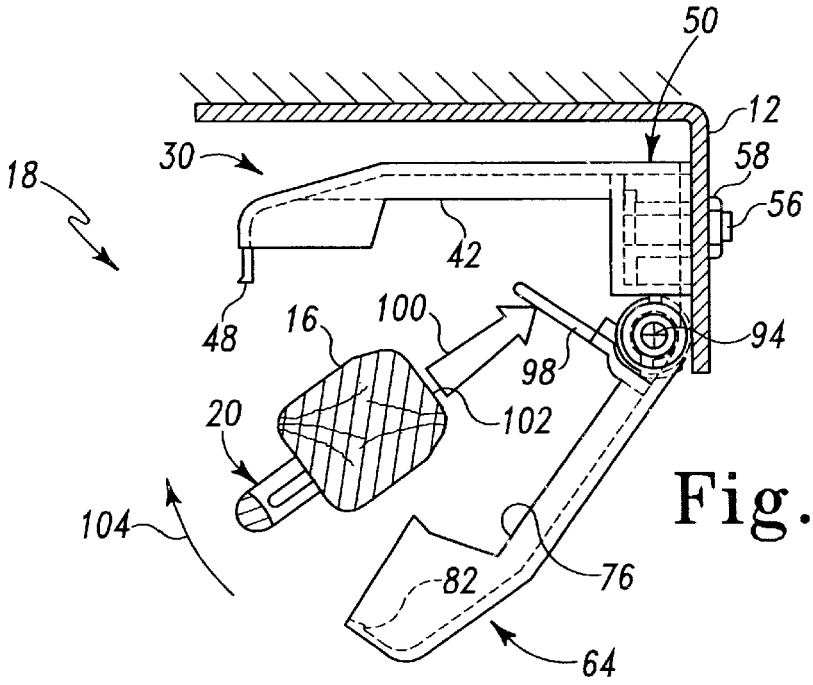
FIG. 4 is a sectional view of the weapon trigger guard mounted on the rack with the cover in an open position for receiving the weapon.
Figure 5:
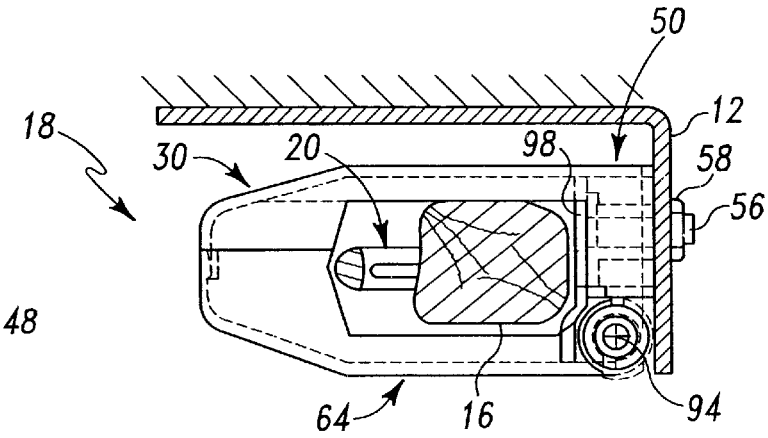
FIG. 5 is a sectional view similar to FIG. 4 illustrating the cover in a closed position with the weapon trigger housing enclosed in the trigger guard.

Base 30 also includes a mounting portion 50 having first and second mounting apertures 52 and 54 which are configured to receive bolts 56. Nuts 58 are then used to secure the base portion 30 to the support member 12 of the gun rack 10 as shown in FIGS. 4 and 5. Mounting portion 50 also includes a cylindrical section 60 having a central aperture 62 for mounting a cover 64 of the weapon trigger guard 18 to the base 30.

Cover 64 includes an outer surface 66 and a side wall 68. Side wall 68 includes first and second side portions 70 and 72 and a front portion 74. First and second side wall portions 70 and 72 each include notched sections 76 and 78, respectively, for receiving a portion of the weapon 16. Strengthening ribs 80 are formed on an interior side of outer surface 66 to strengthen the cover 64.

A second latch portion 82 is formed on front surface 76 of side wall 68. The second latch portion 82 cooperates with the first latch portion 48 on the base 30 to hold the weapon trigger guard 18 in a closed position illustrated in FIG. 5.

Cover 64 further includes a mounting portion 84 having first and second spaced apart cylindrical sections 86 and 88. The cylindrical sections 86 and 88 include an aperture 90 and 92, respectively. A bolt 94 is configured to extend through aperture 92, aperture 62 of base 30, and aperture 90. A nut 96 is used to secure the bolt 94 to the cover 64 to provide a hinge so that the cover 64 pivots relative to the base 30 as discussed below.

A central plate 98 is formed between cylindrical portions 86 and 88 of cover 64. The central plate 98 causes the cover 64 to close automatically when the weapon 16 is installed under the gun rack.

Installation of the weapon into the gun rack is shown in FIGS. 4 and 5. The cover 64 is in an open position shown in FIG. 4 due to gravity. When the weapon 16 is loaded into the gun rack in the direction of arrow 100, a surface 102 of weapon 16 engages the plate 98 and causes the cover 64 to pivot upwardly in the direction of arrow 104. Therefore, when the weapon 16 is fully installed in the gun rack 10, the cover 64 automatically moves to its closed position shown in FIG. 5.

Figure 6:
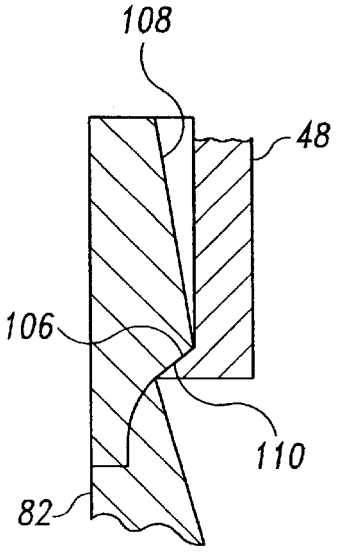
FIG. 6 is a partial sectional view illustrating a latch for holding the cover in the closed position.

The second latching portion 82 on cover 64 engages the first latching portion 48 on base 30 to hold the cover in the closed position shown in FIG. 5. Details of the first and second latch portions are shown in FIG. 6. The first latching portion 48 includes a ledge 106. The second latching portion 82 includes a ramp surface 108 and a ledge 110 which engages the ledge 106 on the first latching portion to hold the cover in the closed position. When the weapon 16 is removed from the rack 10, force is applied by the weapon 16 on the cover 64 so that the cover 64 automatically opens to permit removal of the weapon 16.

The cover 64 and the base 30 of weapon trigger guard 18 cooperate to provide a clamshell-type configuration which automatically closes and conceals the trigger housing 20 of the weapon 16. It is understood that any type of suitable material may be used to form base 30 and cover 64 in accordance with the present invention. It is also understood that a spring closure member or other type of biasing device may be used to hold the cover 64 in a closed position. An over center spring can be used to hold the cover in an open position if the trigger guard 18 is not mounted in an orientation where gravity automatically opens the cover 64.

Although the invention has been described in detail with reference to certain illustrated embodiments, variations and modifications exist within the scope and spirit of the present invention as defined in the following claims:

What is claimed is:

1. A weapon trigger guard apparatus for use on a gun rack having a support member and a lock coupled to the support member, the weapon trigger guard apparatus comprising:

a base rigidly coupled to the support member of the rack; and a cover pivotably coupled to the base, the cover including an outer surface and a side wall, the side wall of the cover being formed to include first and second notched portions to receive a portion of the weapon, and the cover being movable between a first open position to permit installation and removal of the weapon from the rack and a second closed position in which the cover and the base cooperate to completely surround and enclose a trigger housing of the weapon.

2. The apparatus of claim 1, wherein the base includes a first latch portion and the cover includes a second latch portion which cooperates with the first latch portion to hold the cover in the second closed position.

3. The apparatus of claim 1, wherein the base includes a mounting portion configured to receive a fastener to secure the base to the support member of the rack.

4. The apparatus of claim 3, wherein the mounting portion of the base includes first and second spaced apart apertures for receiving first and second fasteners.

5. The apparatus of claim 1, wherein the base includes a first hinge portion and the cover includes a second hinge portion, and further comprising a fastener coupled to the first and second hinge portions to pivotably couple the cover to the base.

6. The apparatus of claim 5, wherein the first hinge portion includes a generally cylindrical portion and the second hinge portion includes first and second cylindrical portions configured to be located on opposite sides of the cylindrical portion of the base, the cylindrical portions each including an aperture configured to receive the fastener.

7. The apparatus of claim 1, wherein the cover includes a plate member configured to be engaged by the weapon to cause pivotable movement of the cover relative to the base as the weapon is installed onto the rack.

8. A weapon tugger guard apparatus for use on a gun rack having a support member and a lock coupled to the support member, the weapon trigger guard apparatus comprising:

a base rigidly coupled to the support member of the rack, the base including an outer surface having an inner portion;

a cover pivotably coupled to the base, the cover including an outer surface having an inner portion, the cover being movable between a first open position to permit installation and removal of the weapon from the rack and a second closed position in which the cover and the base cooperate to completely surround and enclose a trigger housing of the weapon; and a plurality of strengthening ribs formed on the inner portions of the outer surfaces of the base and the cover to strengthen the base and the cover.

9. The apparatus of claim 8, wherein the cover includes an outer surface and a side wall, the side wall of the cover being formed to include first and second notched portions to receive a portion of the weapon.

10. The apparatus of claim 9, wherein the base includes an outer surface and a side wall, the side wall of the base being formed to include third and fourth notched portions configured to receive a portion of the weapon.

11. The apparatus of claim 1, wherein the base includes an outer surface and a side wall, the side wall of the base being formed to include third and fourth notched portions configured to receive a portion of the weapon.

12. A gun rack comprising:

an elongated support member;

a lock coupled to a first portion of the support member, the lock including a lock cover movable between an open position to permit installation and removal of the weapon from the rack and a closed position in which the lock cover locks the weapon to the support member;

a weapon trigger guard apparatus coupled to a second portion of the support member spaced apart from the lock, the weapon trigger guard apparatus including a base rigidly coupled to the support member and a trigger guard cover pivotably coupled to the base, the trigger guard cover being movable between an open position to permit installation and removal of the weapon from the rack and a closed position in which the trigger guard cover and the base cooperate to surround and enclose a trigger housing of the weapon; and wherein the base and the trigger guard cover each include an outer surface, and further comprising a plurality of strengthening ribs formed on an inner portions of the outer surfaces of the base and the trigger guard cover to strengthen the base and the trigger guard cover.

13. The apparatus of claim 12, wherein the base includes a first latch portion and the trigger guard cover includes a second latch portion which cooperates with the first latch portion to hold the trigger guard cover in the closed position.

14. The apparatus of claim 12, wherein the trigger guard cover includes a plate member configured to be engaged by the weapon to cause pivotable movement of the trigger guard cover to the closed position automatically as the weapon is installed onto the rack.

15. The apparatus of claim 14, wherein the trigger guard cover includes an outer surface, and the plate member extends from the trigger guard cover toward the base at an angle relative to the outer surface of the trigger guard cover.

16. The apparatus of claim 15, wherein the plate member is aligned generally perpendicularly to the outer surface of the trigger guard cover.

17. A weapon trigger guard apparatus for use on a gun rack having a support member and a lock coupled to the support member, the weapon trigger guard apparatus comprising a base rigidly coupled to the support member of the rack, a cover pivotably coupled to the base, and a plate member configured to cause pivotable movement of the cover relative to the base as the weapon is installed onto the rack from a first open position to permit installation and removal of the weapon from the rack to a second closed position in which the cover and the base cooperate to substantially conceal a trigger housing of the weapon, the plate member being configured to be engaged by the weapon to cause pivotable movement of the cover relative to the base to the closed position automatically as the weapon is installed onto the rack.

18. The apparatus of claim 17, wherein the cover includes an outer surface, and the plate member extends from the cover toward the base at an angle relative to the outer surface of the cover.

19. The apparatus of claim 18, wherein the plate member is aligned generally perpendicularly to the outer surface of the cover.

* * * * *

UNITED STATES PATENT AND TRADEMARK OFFICE

CERTIFICATE OF CORRECTION

PATENT NO. : 6,438,885 B1 
DATED : August 27, 2002
INVENTOR(S) : Kurt R. Murray and Richard N. Mercurio It is certified that error appears in the above-identified patent and that said Letters Patent is hereby corrected as shown below:

Title page,
Item [73], please correct the following Assignee from "Pro-Guard Industries, L.P., Indianapolis, IN (US)" to -- Pro-Guard Industries, L.P., Industries, IN (US) --

Signed and Sealed this

Thirteenth Day of April, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,438,885 B1 
DATED : August 27, 2002
INVENTOR(S) : Kurt R. Murray and Richard N. Mercurio It is certified that error appears in the above-identified patent and that said Letters Patent is hereby corrected as shown below:

Title page,
Item [73], please correct the following Assignee from "Pro-Guard Industries, L.P., Indianapolis, IN (US)" to -- Pro-Gard Industries, L.P., Indianapolis, IN (US) --

This certificate supersedes Certificate of Correction issued April 13. 2004.

Signed and Sealed this

Twenty-eighth Day of September, 2004

JON W. DUDAS
*Director of the United States Patent and Trademark Office*